US006422977B1

(12) United States Patent
Eschenbach

(10) Patent No.: US 6,422,977 B1
(45) Date of Patent: Jul. 23, 2002

(54) COMPACT ELLIPTICAL EXERCISE MACHINE WITH ADJUSTMENT

(76) Inventor: Paul William Eschenbach, 143 Lakeland Ave., Moore, SC (US) 29369

( * ) Notice: Subject to any disclaimer, the term of this patent is extended or adjusted under 35 U.S.C. 154(b) by 0 days.

(21) Appl. No.: 09/693,195

(22) Filed: Oct. 23, 2000

Related U.S. Application Data

(63) Continuation-in-part of application No. 09/416,122, filed on Oct. 12, 1999, now Pat. No. 6,168,552, which is a continuation-in-part of application No. 09/246,889, filed on Feb. 8, 1999, now Pat. No. 6,024,676, which is a continuation-in-part of application No. 08/871,371, filed on Jun. 9, 1997, now Pat. No. 5,957,814.

(51) Int. Cl.[7] ..... A63B 69/16; A63B 22/04
(52) U.S. Cl. ..... 482/52; 482/51
(58) Field of Search ..... 482/51, 52, 53, 482/57, 70, 79, 80

(56) References Cited

U.S. PATENT DOCUMENTS

| | | | | |
|---|---|---|---|---|
| 5,242,343 A | 9/1993 | Miller | ..... | 482/57 |
| 5,423,729 A | 6/1995 | Eschenbach | ..... | 482/70 |
| 5,685,804 A | 11/1997 | Whan-Tong et al. | ..... | 482/51 |
| 5,692,994 A | 12/1997 | Eschenbach | ..... | 482/57 |
| 5,788,610 A | 8/1998 | Eschenbach | ..... | 482/52 |
| 5,836,854 A | 11/1998 | Kuo | ..... | 482/52 |
| 5,893,820 A | 4/1999 | Maresh et al. | ..... | 482/51 |
| 5,957,814 A | 9/1999 | Eschenbach | ..... | 482/51 |
| 5,997,445 A | 12/1999 | Maresh et al. | ..... | 482/70 |
| 6,042,512 A | 3/2000 | Eschenbach | ..... | 482/52 |

*Primary Examiner*—Stephen R. Crow

(57) ABSTRACT

The present invention relates to a standup exercise apparatus that simulates walking, jogging and climbing with arm exercise. More particularly, the present invention relates to an exercise machine having separately supported pedals for the feet and arm exercise coordinated with the motion of the feet.

Elliptical trainers guide the feet along a generally elliptical shaped curve to simulate the motions of jogging and climbing. Existing elliptical trainers consume excessive floor-space and often lack adjustable pedal motion. The present invention is an improved elliptical exercise machine capable of extended exercise with adjustable pedal motion during operation. Further, the elliptical trainer is more compact with a smaller footprint to conserve floor space.

The intermediate portion of a foot support member is guided by a guide member and drives a crank linkage on one end with pedal on the other end. The resulting pedal motion is foot friendly. Handles are connected to the crank linkage for coordinated arm exercise.

24 Claims, 6 Drawing Sheets

COMPACT ELLIPTICAL EXERCISE MACHINE WITH ADJUSTMENT

This application is a Continuation-in-Part of application Ser. No. 09/416,122 filed Oct. 6, 1999 now U.S. Pat. No. 6,168,552 which is a Continuation-in-Part of Ser. No. 09/246,889 filed Feb. 8, 1999 now U.S. Pat. No. 6,024,676 which is a Continuation-in-Part of Ser. No. 08/871,371 filed Jun. 9, 1997 U.S. Pat. No. 5,957,814.

BACKGROUND OF THE INVENTION

1. Field

The present invention relates to a standup exercise apparatus that simulates walking, jogging and climbing with arm exercise. More particularly, the present invention relates to an exercise machine having separately supported pedals for the feet and arm exercise coordinated with the motion of the feet. Pedal motion is adjustable.

2. State of the Art

The benefits of regular exercise to improve overall health, appearance and longevity are well documented in the literature. For exercise enthusiasts the search continues for safe apparatus that provides full body exercise for maximum benefit in minimum time.

Recently, a new category of exercise equipment has appeared on the commercial market called elliptical cross trainers. These cross trainers guide the feet along a generally elliptical shaped curve to simulate the motions of jogging and climbing. Generally they are large exercise machines using long cranks to generate a long foot stride. There is a need for a more compact elliptical exercise machine capable of a similar long stride using a linkage to modify the crank.

Recently, there has been an effort to improve the up and down motion of stair climbers by the addition of horizontal movements. Habing in U.S. Pat. Nos. 5,299,993 and 5,499,956 offers an articulated linkage controlled through cables by motor to move pedals through an ovate path. Both pedal pivots follow basically the same guidance path curve directed by a motor controller. Stearns in U.S. Pat. Nos. 5,290,211 and 5,299,993 shows a stair stepping exercise machine which incorporates horizontal movement using a combination of vertical parallelogram linkage and horizontal parallelogram linkage to guide the foot pedals. The parallelogram linkages serve to maintain the pedal at a constant angle relative to the floor during a pedal cycle. The pedal pivots move through similar undefined guide paths.

Standup cycling is described in various patents such as U.S. Pat. No. 3,563,541 (Sanquist) which uses weighted free pedals as load resistance and side to side twisting motion. Also U.S. Pat. Nos. 4,519,603 and 4,477,072 by DeCloux describe standup cycling with free pedals in a lift mode to simulate body lifting. Eschenbach in U.S. Pat. No. 5,279,529 shows several embodiments of elliptical pedal motion configured to maintain the heel of the user on the pedal during a substantial portion of the pedal cycle.

Standup pedal exercise is shown in U.S. Pat. No. 4,643,419 (Hyde) and by Jarriel et al. In U.S. Pat. No. D330,236 where pedal platforms move by dual crank motion but remain parallel to the floor. Knudsen in U.S. Pat. No. 5,433,680 shows an elliptical path generating mechanism with pedals having only one pivot allowing the pedal to rotate unconstrained about the pivot as in a bicycle crank.

Standup pedal exercise combined with arm levers attached to the pedals is shown in Kummerlin et al. German Pat. No. 2,919,494 and in Geschwender U.S. Pat. No. 4,786,050. Standup pedal exercise coupled with oscillating swing arms is shown in Miller U.S. Pat. Nos. 5,242,343 and 5,383,829 and in Eschenbach U.S. Pat. No. 5,423,729. All of these exercise machines use pedals having two pedal pivots which are guided by a first circular guide path curve generated by a crank which rotates through one full revolution during a pedal cycle and a second arc guide path curve generated by a rocker link or track.

Recently, numerous elliptical exercise machines have appeared in the patent literature. Rogers,Jr. in U.S. Pat. Nos. 5,527,246, 5,529,555, 5,540,637, 5,549,526, 5,573,480, 5,591,107, 5,593,371, 5,593,372, 5,595,553, 5,611,757, 5,637,058, 5,653,662 and 5,743,834 shows elliptical pedal motion by virtue of various reciprocating members and geared linkage systems. Miller in U.S. Pat. Nos. 5,518,473, 5,562,574, 5,611,756, 5,518,473, 5,562,574, 5,577,985, 5,755,642 and 5,788,609 also shows elliptical pedal motion using reciprocating members and various linkage mechanisms along with oscillating guide links with control links to determine pedal angles. Ryan et al. in U.S. Pat. No. 5,899,833 shows an elliptical cross trainer having a forward crank driving a pedal linkage underneath the operator.

Chang in U.S. Pat. No. 5,803,872 and Yu et al. in U.S. Pat. No. 5,800,315 show a pedal supported by a rocker link and driven with a pair of links located under the pedal pivotally connected to a crank. Maresh et al. in U.S. Pat. No. 5,792,026 show a foot support member supported by a rocker link and driven by a double crank mechanism. Maresh in U.S. Pat. No. 5,897,463 shows a foot platform with parallel movement as the the foot platform follows an oval path. Lee in U.S. Pat. No. 5,779,598 and Chen in U.S. Pat. No. 5,823,914 show a pedal link driven by two separate cranks. Lin et al. in U.S. Pat. No. 5,769,760 offers elliptical foot and hand motion. Sands et al. U.S. Pat. No. 5,755,643 shows elliptical foot motion with folding front post.

Lee in U.S. Pat. No. 5,746,683 shows a foot support member supported on one end with a compound rocker wherein a slider and handle lever support the rocker. Kuo in U.S. Pat. No. 5,836,854 offers a linear foot support member connected on one end to a crank and guided along an arcuate curve under the pedal by a linkage on the other end. Wang et al. U.S. Pat. No. 5,830,112 shows a foot support member sliding on a pivot on one end and attached to a crank on the other that can fold. Chen U.S. Pat. No. 5,823,917 shows a foot support member driven by a crank on one end and supported by a stationary roller on the other. Chen U.S. Pat. No. 5,820,524 offers a slider crank mechanism having a pedal pivotally attached with a control link to articulate the pedal angle.

Chen U.S. Pat. Nos. 5,779,599 and 5,762,588 shows an elliptical pedal movement with a roller interface between the foot support member and crank. Chen in U.S. Pat. No. 5,759,136 shows a foot support member with a moving pedal for adjustable elliptical motion wherein a link from the pedal to the crank can be repositioned to change the pedal stroke length. Kuo U.S. Pat. No. 5,846,166 shows a foot support member guided on one end by a roller and driven on the other end by a four bar linkage. Stearns et al. in U.S. Pat. No. 5,848,954 offers a foot support member pivoted on one end with a lift crank on the other and a pedal moving on the foot support member to generate elliptical type foot motion.

Maresh et al. in U.S. Pat. Nos. 5,893,820 and 5,997,445 shows an adjustable lift elliptical cross trainers. Kuo U.S. Pat. No. 5,836,854 shows a foot support member driven by a crank and guided on one end by a linkage hanging from a "Z" shaped bar that may be adjusted. Whan-Tong et al. in U.S. Pat. No. 5,685,804 shows a foot support member driven by a simple crank having an adjustable ramp to vary pedal lift. Eschenbach in U.S. Pat. No. 5,692,994 shows an elliptical cross trainer which has an adjustable upright support member which allows variable pedal motion.

There is a need for a compact pedal operated exercise machine that can be safely operated in the standup position whereby the arms and legs can be exercised with the feet moving through a generally elliptical movement that can be adjusted.

It is one objective of this invention to provide an elliptical pedal movement with a crank linkage that provides a compact and simple exercise machine with a small footprint. Another object of this invention is to provide an oblong pedal path that can be adjusted during operation of the exercise machine. Yet another object of this invention is to provide arm exercise that is coordinated with the pedal movement.

SUMMARY OF THE INVENTION

The present invention relates to the kinematic motion control of pedals which simulate running, climbing and cycling during several modes of operation. More particularly, apparatus is provided that offers variable intensity exercise through a leg operated cyclic motion in which the pedal supporting each foot is guided through successive positions during the motion cycle while a load resistance acts upon the mechanism.

The pedals are guided through an oblong or elongate curve motion while pedal angles vary during the pedal cycle to maintain the heel of the foot generally in contact with the pedal. As the foot is raised, the heel of the foot remains generally in contact with the inclining pedal for safer operation. Arm exercise is by arm levers coordinated with the mechanism guiding the foot pedals.

In the preferred embodiment, the apparatus includes a separate pedal for each foot, each pedal being extended by a foot support member and partially supported by an oblong guide path curve for the first foot support member portion at a foot support pivot. The oblong guide path generating mechanism has a rotary crank which completes one full revolution during a pedal cycle and is phased generally opposite the crank for the other pedal through a crankshaft bearing housing attached to the framework.

A rocker link is pivotally connected to the framework. A coupler link is connected to the crank at a crank pivot and the rocker link is connected to the coupler link at a rocker pivot to form a path generating mechanism. The coupler link is connected to the foot support member at a foot support pivot in the portion that follows an elongate guide path curve. The rocker pivot is offset relative to a line connecting the crank pivot and foot support pivot on the coupler link. Further, the crank pivot is located at one end of the coupler link while the rocker pivot is located intermediate the ends.

The foot support member is supported at a second foot support member portion with a pivot by foot support guides configured as rollers supported by curved tracks supported by the framework. As the crank is driven by foot motion, the pedal follows an elongate curve approximating an ellipse.

Arm exercise is provided with handles pivotally connected to the framework. A connecting link is pivotally connected to each handle and each coupler link between the foot support member and the rocker to coordinate the arm movement with the foot. When the foot is forward, the handle corresponding to that foot is generally rearward.

The curved tracks are also supported by a lever arm pivoted to the framework and connected to an actuator. The actuator is pivotally connected to the framework. A control system positioned near the operator can adjust the actuator during operation to reposition the curved tracks for a change in pedal motion.

Load resistance is imposed upon the crank through pulleys and chain from a flywheel having a friction belt around a portion of the circumference. Adjustment of belt tension varies the load resistance either by manual or actuator adjustment. The actuator can varied during operation through a control system within easy reach of the operator. Other forms of load resistance such as alternator, magnetic, air, belt, etc. may also be used.

In an alternate embodiment, the coupler link is shown with the rocker pivot located at one end of the coupler link while the crank pivot is located intermediate the ends. The tracks are pivotally connected to the framework at the forward ends of the tracks. An actuator controlled lever arm supports the rearward end of the tracks. The remainder of the exercise machine is similar to the preferred embodiment.

In another alternate embodiment, curved tracks that support the second portion of the foot support member are movable horizontally in the back and forth direction. An actuator will reposition the curved tracks during operation as directed by a control system to change the pedal motion. The remainder of the exercise machine is similar to the preferred embodiment.

In summary, this invention provides the operator with stable foot pedal support having motions that simulate running, climbing and cycling with very low joint impact and upper body exercise in a compact space. The pedal motion is adjustable during operation. Arm exercise is coordinated with the pedal motion.

DETAILED DESCRIPTION OF THE EMBODIMENTS

Figure 1:
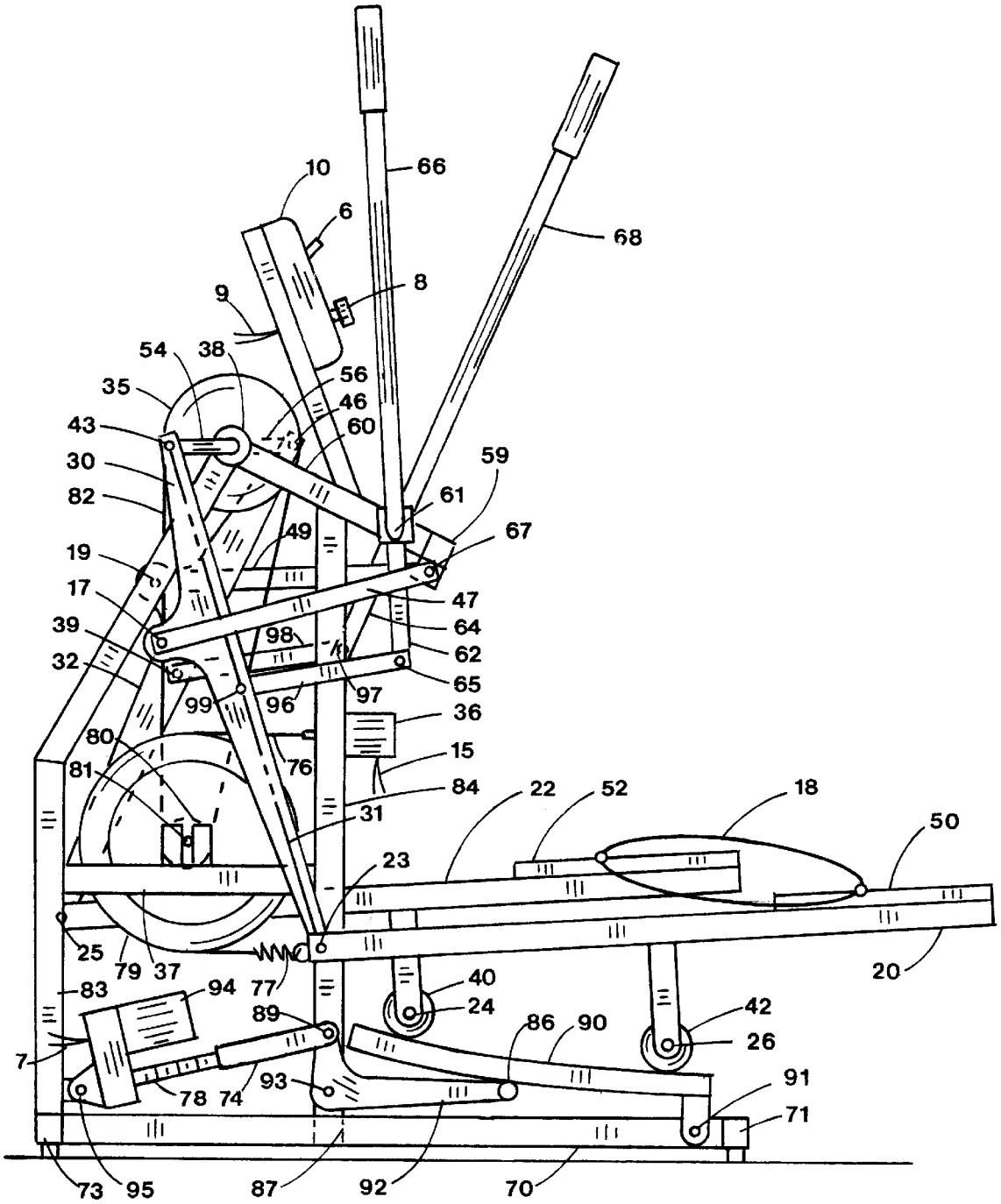
FIG. 1 is a right side elevation view of the preferred embodiment of an exercise machine constructed in accordance with the present invention.
Figure 2:
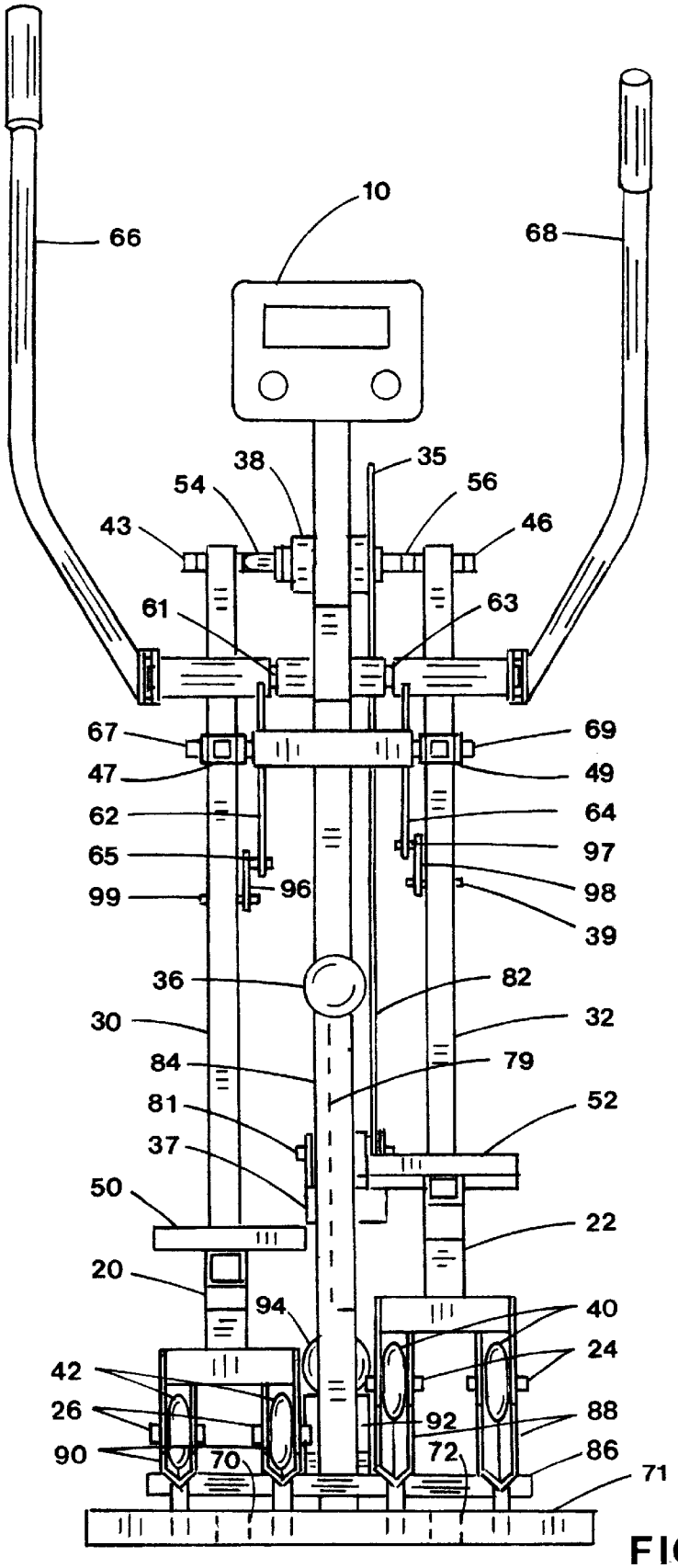
FIG. 2 is the rear view of the preferred embodiment shown in FIG. 1.

Referring to the drawings in detail, pedals 52 and 50 are shown in FIGS. 1 and 2 in the most forward and rearward positions of the first embodiment. Pedals 50 and 52 are supported by foot support members 20 and 22 which have first foot support pivots 23,25 in a first portion and second foot support pivots 26,24 in a second portion, respectively. Foot support pivots 23 and 25 are pivotally attached to coupler links 30 and 32 which guide pedal pivots 23 and 25 along an elongate guide path curve similar to guide path curve 5 shown in FIG. 3.

Coupler link 30 is connected to rocker link 47 at rocker pivot 17 and to crank 54 at crank pivot 43 while coupler link 32 is connected to rocker link 49 at rocker pivot 19 and to crank 56 at crank pivot 46. Rocker pivot 17 is offset relative to line 31 which connects crank pivot 43 to foot support pivot 23 on coupler link 30. Rocker pivot 19 on coupler link 32 is also offset. Any one of the three pivots 17,43,23 can be offset relative to a line connecting the other two on coupler link 30 and be within the scope of the present invention.

Cranks 54 and 56 are connected in opposing directions by crankshaft journal 55 (not shown) which is rotatably secured to the framework by bearing housing 38. Rocker links 47 and 49 are pivotally attached to crossover support member 59 at pivots 67 and 69, respectively. Cranks 54,56, rocker links 47,49 and coupler links 30,32 form a path generating mechanism.

Handles 66,68 are attached to support member 60 at pivots 61,63 for arm exercise. Handle extensions 62,64 are offset relative to handles 66,68. Connector links 96,98 are connected to handle extensions 62,64 by pivots 65,97 and to coupler links 30,32 at pivots 99,39.

Curved tracks 90,88 are supported by pivots 91 to frame members 70,72. Rollers 42,40 are attached to foot support members 20,22 in a second portion at pivots 26,24 and in rollable contact with curved tracks 90,88 for back and forth movement. Curved tracks 90,88 are also supported by track support 86 which is attached to lever arm 92. Lever arm 92 is connected to the frame member 84 at pivot 93 and to screw extension 74 at pivot 89. Screw extension 74 can be moved by screw 78 which is driven by actuator 94 that is attached to frame member 83 at pivot 95.

Frame members 70 and 72 are attached to crossover members 71,73 configured to be supported by the floor. Frame members 83,84 are attached to frame members 70,72, 87 and support crank housing 38. Support member 60 is attached to frame member 84 and crank housing 38. Crossover frame member 59 is attached to frame member 60.

Flywheel 79 is rotatably supported at pivot 81 which is journaled to flywheel support members 37,39 which are connected to frame members 83,84. Load resistance is imposed upon crank 54,56 by sprocket 35 which is connected to a smaller sprocket 80 by chain 82 to drive the flywheel 79. Friction belt 76 applies frictional resistance to flywheel 79 rotation by actuator 36 attached to frame member 84. Load resistance is varied by actuator 36 to vary the length of springs 77.

Control system 10 is attached to support member 60. Wires 9 are connected to actuator wires 7,15 by conventional means not shown. The switch 6 can be manually changed during operation by the operator to vary load intensity or by automatic program. The switch B can be manually changed during operation by the operator to vary pedal motion or by automatic program.

Application of body weight on the pedals 50,52 and force applied at the arm levers 66,68 cause the flywheel 79 to rotate for a gain in momentum while the pedals 50,52 follow the pedal curve 18 shown adjusted to a stride pedal 50,52 motion. Adjustment of actuator 94 will reposition the curved tracks 90,88 to offer a climbing pedal motion similar to curve 14 shown in FIG. 4. The flywheel 79 momentum will carry the linkage system through any dead center positions of the crank 54,56. The pedals 50,52 and arm levers 66,68 can be operated to drive the flywheel 79 in either direction of rotation.

Figure 3:
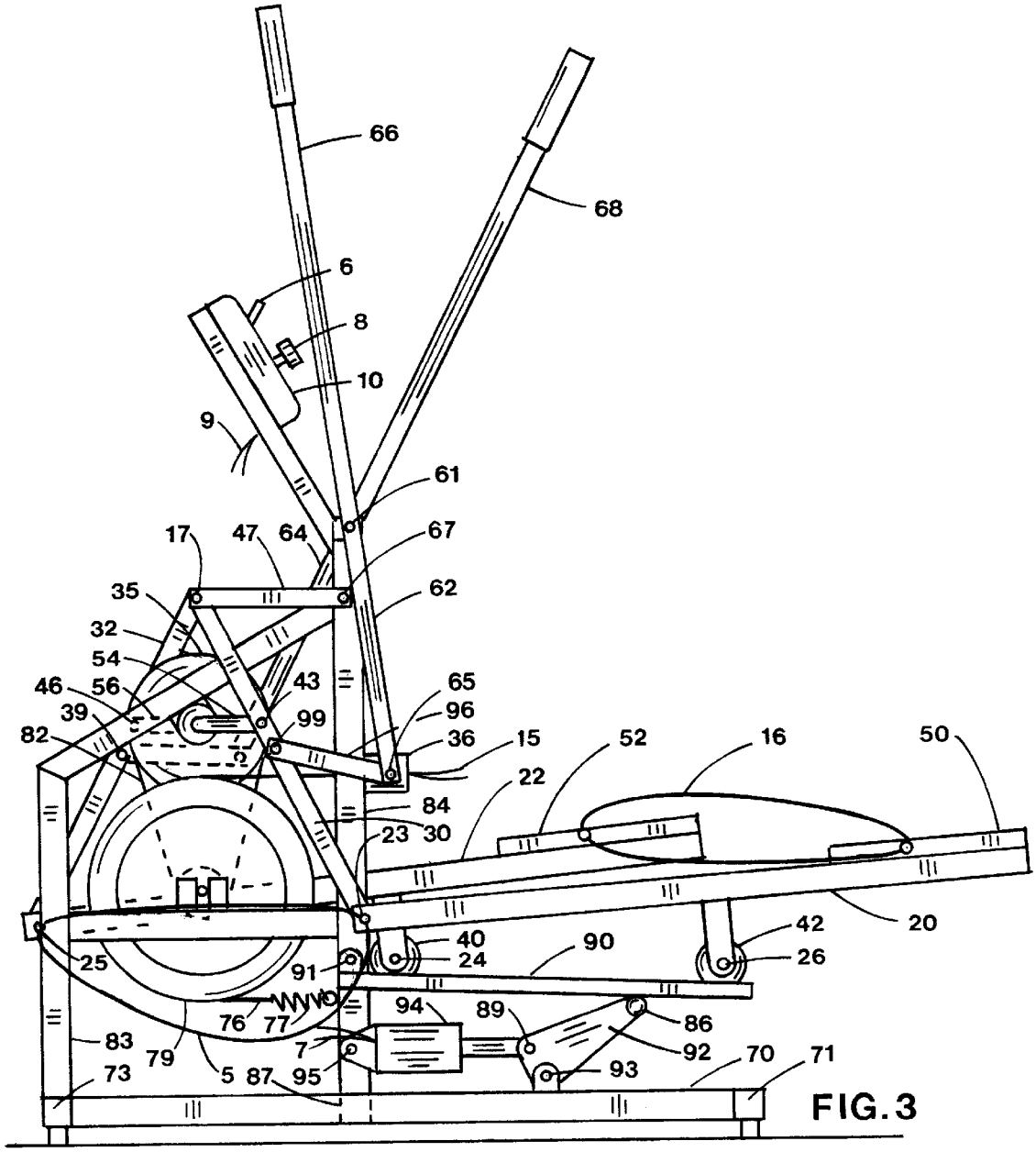
FIG. 3 is a side elevation view of an alternate embodiment of the present invention adjusted for stride pedal motion.
Figure 4:
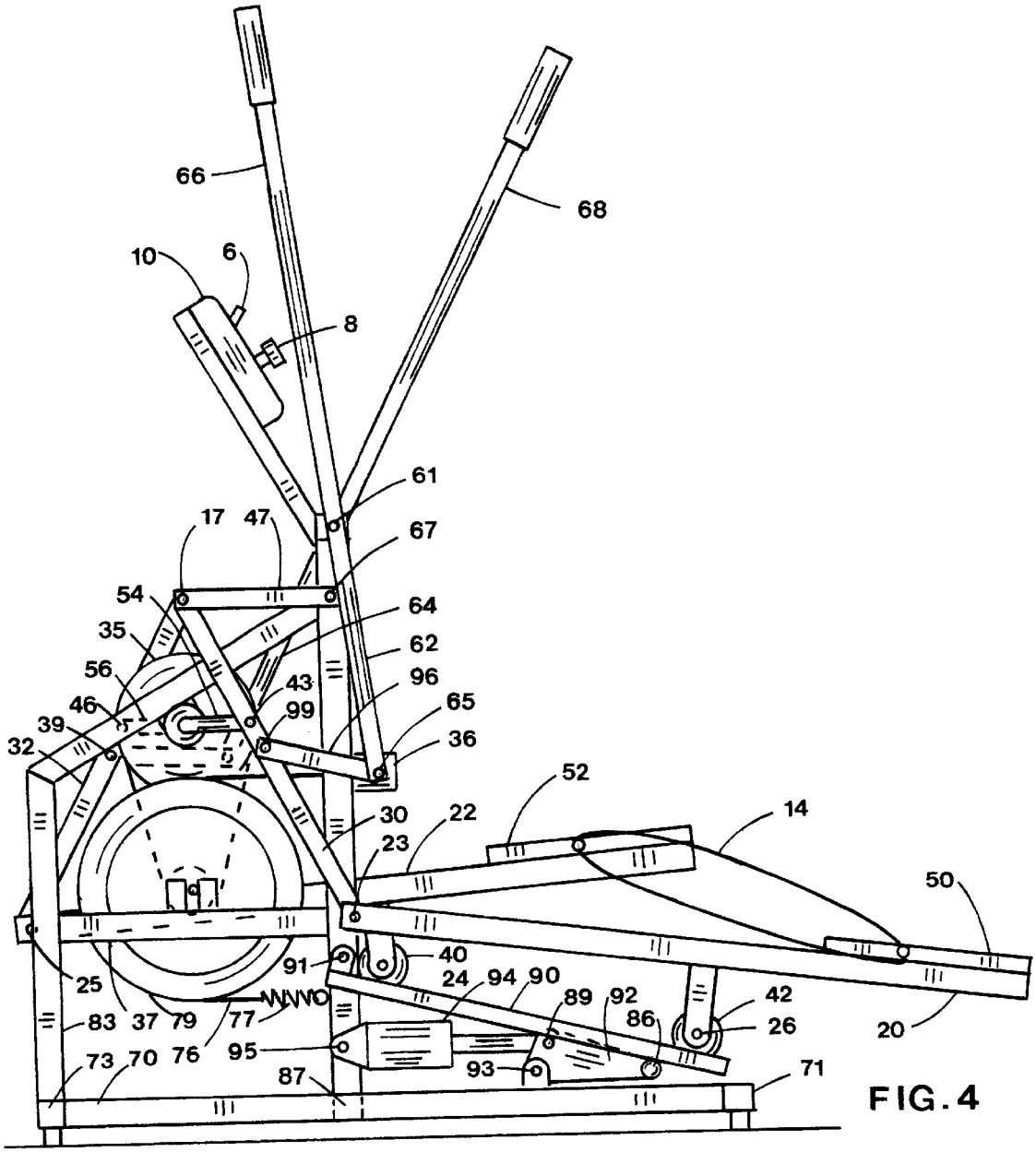
FIG. 4 is a side elevation view of the alternate embodiment of FIG. 3 adjusted to the climb pedal motion.

In an alternate embodiment, pedals 50,52 are shown in the most rearward and forward positions in FIGS. 3 and 4. Coupler links 30,32 have rocker pivots 17,19 shown at one end while crank pivots 43,46 are positioned intermediate the ends. The other end of coupler links 30,32 are attached to the first portion of foot support members 20,22 at pivots 23,25. Cranks 54,56, rocker links 47,49 and coupler links 30,32 form a path generating mechanism that generates elongate curve 5 which supports the first portion of foot support members 20,22.

Tracks 90,88 are connected at the forward end to frame member 84 at pivot 91 and supported at the the rearward end by track support 86. Track support 86 is attached to lever arm 92 which is connected to frame members 70,72 at pivot 93 and to actuator 94 at pivot 89. Actuator 94 is connected to frame member 84 at pivot 95. Control system 10 causes actuator 94 to raise or lower the rearward ends of tracks 90,88 during operation. FIG. 3 shows the actuator 94 adjusted for the stride curve 16 for pedals 50,52. FIG. 4 shows actuator 94 adjusted for climb curve 14 for pedals 50,52. The remainder of this alternate embodiment is similar to the preferred embodiment.

Figure 5:
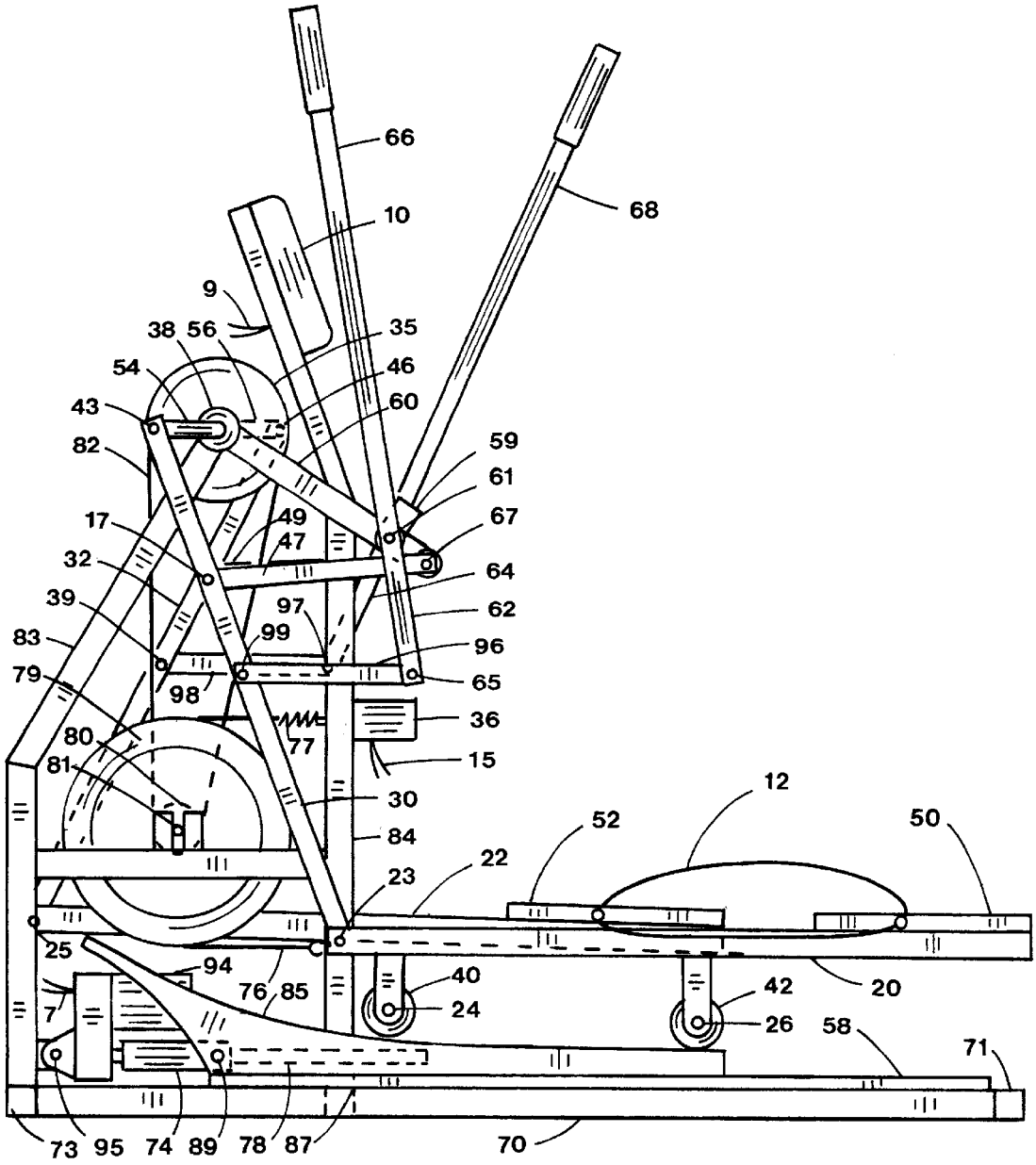
FIG. 5 is a side elevation view of another alternate embodiment of the present invention adjusted for stride pedal motion.
Figure 6:
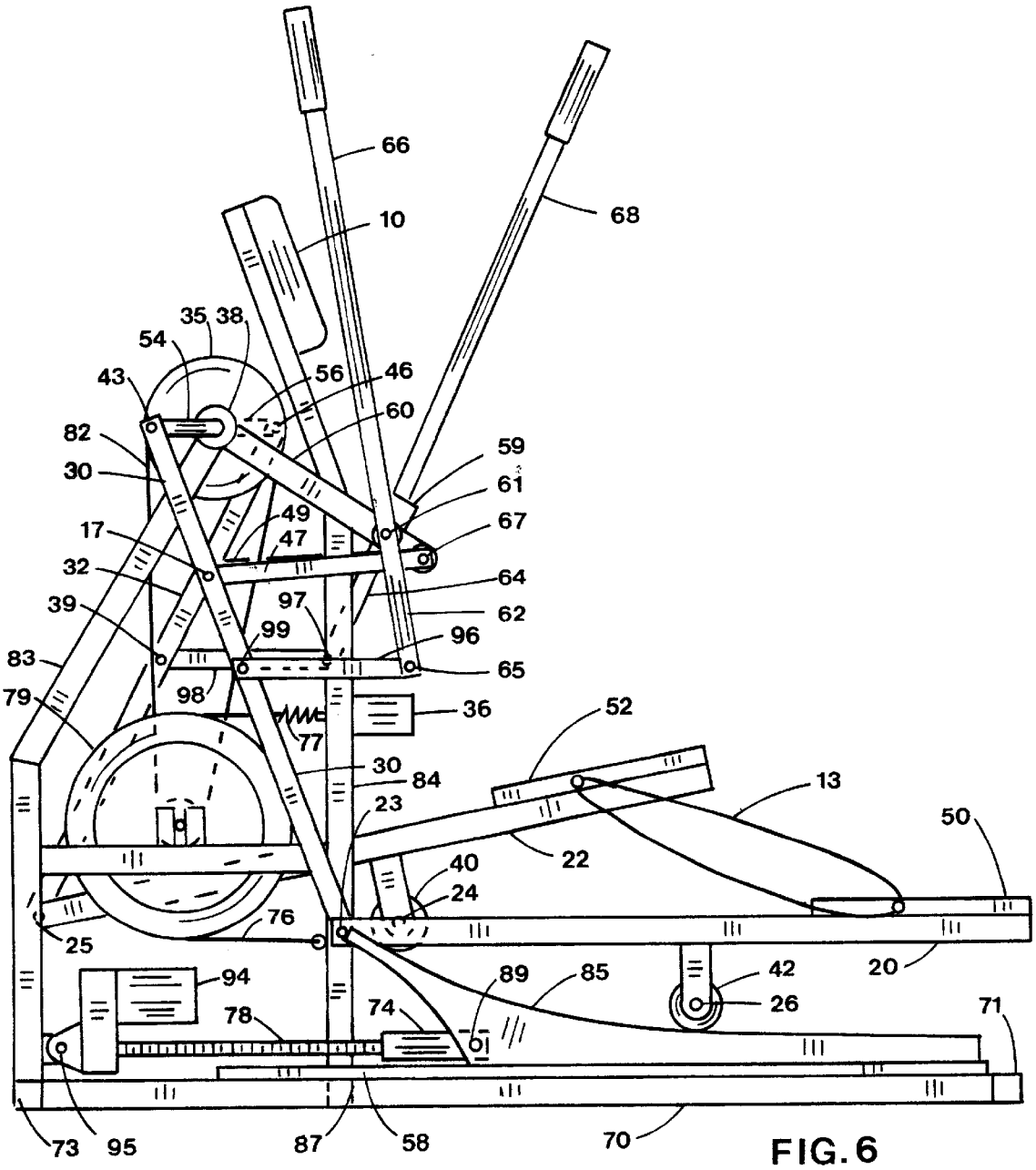
FIG. 6 is a side elevation view of the alternate embodiment of FIG. 3 adjusted to the climb pedal motion.

Another alternate embodiment is shown in FIGS. 5 and 6 with pedals 50,52 shown in their most rearward and forward positions. Curved tracks 85 are supported by track guides 58 to move back and forth on frame members 70,72. Actuator 94 is connected to frame member 83 at pivot 95. Actuator screw 78 will move actuator extension 74 which is attached to curved tracks 85 at pivot 89. FIG. 5 shows curved tracks 85 in their most forward position to allow pedals 50,52 to follow stride pedal curve 12.

Control system 10 will move curved tracks 85 to a more rearward position shown in FIG. 6 to allow pedals 50,52 to follow climb pedal curve 13. The remainder of this alternate embodiment is similar to the preferred embodiment.

The present invention may be embodied in other specific forms without departing from its spirit or essential characteristics. The described embodiments are to be considered in all respects only as illustrative, and not restrictive. The scope of the invention is, therefore, indicated by the claims, rather than by foregoing description. All changes which come within the meaning and range of equivalency of the claims are to be embraced within their scope.

What is claimed is:

1. An exercise machine comprising:

a framework, said framework configured to be supported by the floor;

a pair of foot support members, each having a first portion, a second portion and a foot engaging pedal;

a crank, said crank rotatably attached to said framework projecting outwardly therefrom on both sides thereof;

a pair of path generating mechanisms, each said path generating mechanism including a plurality of links operably associated with said crank and said framework to support said first portion of said foot support member;

a pair of curved tracks, each said curved track operably associated with said foot support member and said framework to cause said second portion of said foot member to have a back and forth movement;

said curved tracks movable horizontally back and forth relative to said frame to change the pedal motion ; a pair of rollers each rotatably connected to said second porion of a respective said foot support member and in rollable contact with a respective curved track;

said pedal configured to move relative to said framework when the foot of the user is rotating said crank whereby said pedal follows an oblong curve path with non-parallel angular pedal movement.

2. The exercise machine according to claim 1 wherein said oblong curve path is generally elliptical in shape.

3. The exercise machine according to claim 1 wherein each said path generating mechanism comprises a linkage, said linkage including a rocker link pivotally connected to said framework and, a coupler link operably associated with said crank and said rocker link, said linkage configured to guide said first portion of said foot support member.

4. The exercise machine according to claim 1 further comprising a means for arm exercise, said means for arm exercise operably associated with said path generating mechanism.

5. The exercise machine according to claim 4 wherein said means for arm exercise comprises a pair of handles, each said handle pivotally connected to said framework and a pair of connector links, each said connector link operably associated with said handle and said path generating mechanism.

6. The exercise machine according to claim 1 further comprising a flywheel, said flywheel rotatably connected to said framework and operably associated with said crank.

7. The exercise machine according to claim 1 further comprising a load resistance, said load resistance operably associated with said crank, a means for adjustment of said load resistance and, a control system, said control system positioned within reach of the operator whereby said load resistance can be varied during operation of said exercise machine.

8. The exercise machine according to claim 1 wherein said foot support member is configured with said pedal on one end and said first portion at the other end with said second portion positioned intermediate the ends.

9. The exercise machine according to claim 1 wherein said curved track is inclined relative to said floor.

10. The exercise machine according to claim 3 wherein said crank is pivotally connected to one end of said coupler link and said first portion of said foot support member is pivotally connected to the other end of said coupler link.

11. The exercise machine according to claim 3 wherein said crank is connected to said coupler link at a crank pivot, said foot support member is connected to said coupler link at a foot support pivot and, said rocker link is connected to said coupler at a rocker pivot positioned offset relative to a line connecting said crank pivot and said foot support pivot.

12. The exercise machine according to claim 1 further comprising a means to adjust said curved track, said means to adjust said curved track operably associated with said curved track and said framework, and a control system, said control system positioned within reach of the operator whereby said means to adjust said curved track can be varied during operation of said exercise machine to change the pedal motion.

13. The exercise machine according to claim 1 wherein said curved track is pivoted on the forward end to allow the rearward end of said curved track to be raised or lowered to change the pedal motion.

14. The exercise machine according to claim 3 wherein said rocker link is pivotally connected to one end of said coupler link and said first portion of said foot support member is pivotally connected to the other end of said coupler link.

15. An exercise machine comprising:

a framework, said framework configured to be supported-by the floor;

a pair of foot support members, each having a first portion, a second portion and a foot engaging pedal;

a crank, said crank rotatably attached to said framework projecting outwardly therefrom on both sides thereof;

a pair of path generating mechanisms, each said path generating mechanism including a plurality of links operably associated with said crank and said framework to support said first portion of said corresponding foot support member along an elongate curve path;

a pair of curved tracks, each said curved track movable back and forth in a horizontal direction relative to said framework and, said curved track operably associated with said foot support member to cause said second portion of said foot member to have a back and forth movement;

a pair of rollers, each said roller rollably attached to said second portion of said foot support member and in rollable contact with said curved track;

a means for adjustment, said means for adjustment operably associated with said curved track and said framework;

said pedal configured to move relative to said framework when the foot of the user is rotating said crank whereby said means for adjustment can be adjusted to change the pedal motion of said exercise machine.

16. The exercise machine according to claim 15 wherein each said path generating mechanism comprises a linkage, said linkage including a rocker link pivotally connected to said framework and, a coupler link operably associated with said crank and said rocker link, said linkage configured to guide said first portion of said foot support member.

17. The exercise machine according to claim 15 further comprising a means for arm exercise, said means for arm exercise operably associated with said path generating mechanism.

18. The exercise machine according to claim 17 wherein said means for arm exercise comprises a pair of handles, each said handle pivotally connected to said framework and a pair of connector links, each said connector link operably associated with said handle and said corresponding path generating mechanism.

19. The exercise machine according to claim 15 further comprising a flywheel, said flywheel rotatably connected to said framework and operably associated with said crank.

20. The exercise machine according to claim 15 further comprising a load resistance, said load resistance operably associated with said crank, a means for adjustment of said load resistance and, a control system, said control system positioned within reach of the operator whereby said load resistance can be varied during operation of said exercise machine.

21. The exercise machine according to claim 16 wherein said rocker link is pivotally connected to one end of said coupler link and said first portion of said foot support member is pivotally connected to the other end of said coupler link.

22. The exercise machine according to claim 16 wherein said crank is connected to said coupler link at a crank pivot, said foot support member is connected to said coupler link at a foot support pivot and, said rocker link is connected to said coupler at a rocker pivot positioned offset relative to a line connecting said crank pivot and said foot support pivot.

23. The exercise machine according to claim 15 further comprising a control system, said control system positioned within reach of the operator whereby said means for adjustment can be varied during operation of said exercise machine to change the pedal motion.

24. The exercise machine according to claim 16 wherein said crank is connected to one end of said coupler link at said crank pivot and said first portion of said foot support member is connected to the other end of said coupler link at said foot support pivot.

* * * * *